United States Patent [19]

Janda et al.

[11] 3,992,903

[45] Nov. 23, 1976

[54] SEAMLESS GARMENT INCLUDING METHOD OF AND MACHINE FOR KNITTING THE SAME

[75] Inventors: Richard M. Janda, Reading; Kenneth C. Williams, Sinking Spring, both of Pa.

[73] Assignee: Rockwell International Corporation, Pittsburgh, Pa.

[22] Filed: Jan. 27, 1975

[21] Appl. No.: 544,261

Related U.S. Application Data

[62] Division of Ser. No. 488,585, July 15, 1974.

[52] U.S. Cl. ..... 66/177

[51] Int. Cl.[2] ..... A41B 9/02; A41B 9/04; A41B 9/10

[58] Field of Search ..... 66/177, 175, 176, 179, 66/43, 185

[56] References Cited

UNITED STATES PATENTS

| | | | |
|---|---|---|---|
| 2,939,303 | 6/1960 | Coile et al. | 66/43 |
| 3,599,241 | 8/1971 | Rossler | 66/176 X |
| 3,748,870 | 7/1973 | Fregeolle | 66/177 |
| 3,924,423 | 12/1975 | Lonati | 66/177 |

FOREIGN PATENTS OR APPLICATIONS

| | | | |
|---|---|---|---|
| 68,944 | 9/1969 | Germany | 66/177 |
| 142,900 | 5/1902 | Germany | 66/175 |
| 1,807,974 | 7/1970 | Germany | 66/177 |
| 444,429 | 3/1936 | United Kingdom | 66/177 |
| 1,246,499 | 9/1971 | United Kingdom | 66/176 |

*Primary Examiner*—Ronald Feldbaum

[57] ABSTRACT

A one-piece seamless garment is knitted by a new method on an improved circular knitting machine. The garment includes a body portion with a pair of leg receiving opening, a pair of side panels and a front panel and a rear panel joined at a crotch between the leg openings. Each of the front and rear panels includes knitting courses formed during reciprocation of the machine that overlap the knitting courses of the other panel at the crotch. Other knitting courses are formed in the garment remote from the crotch and distributed among the courses that extend into the crotch to provide the garment with a contour matching that of the wearer. Integral leg portions may be provided to the garment by rotary knitting at each leg receiving opening of the body portion. A waist opening and waistband may also be provided as the garment is being knitted.

19 Claims, 8 Drawing Figures

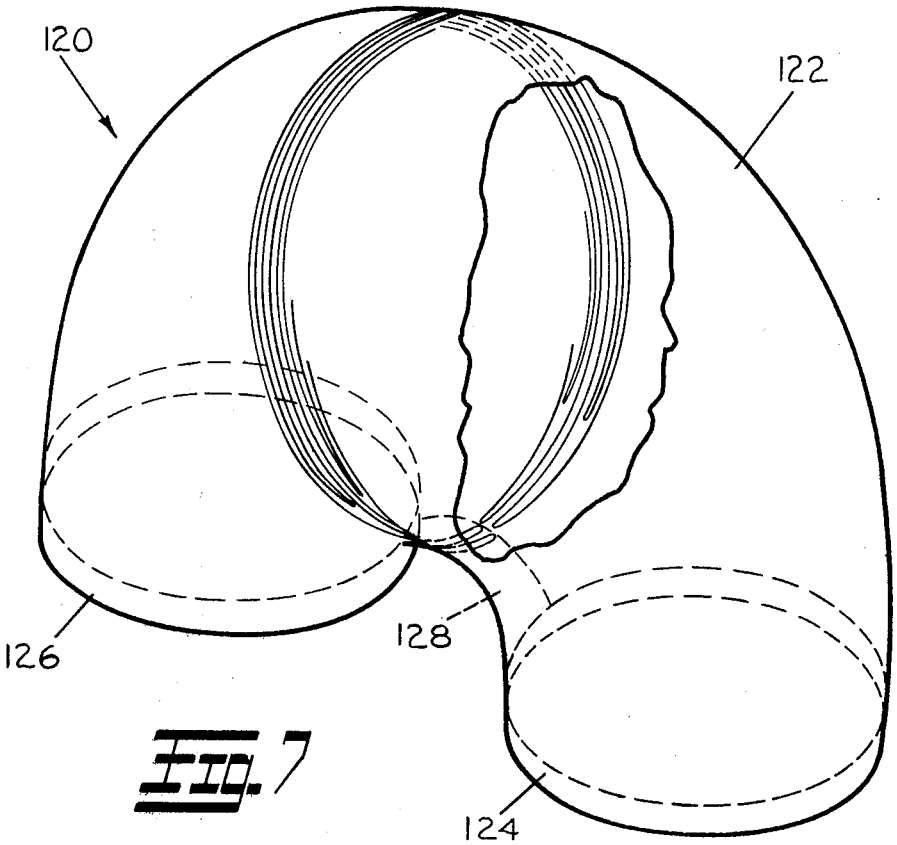
Fig. 7
Fig. 8
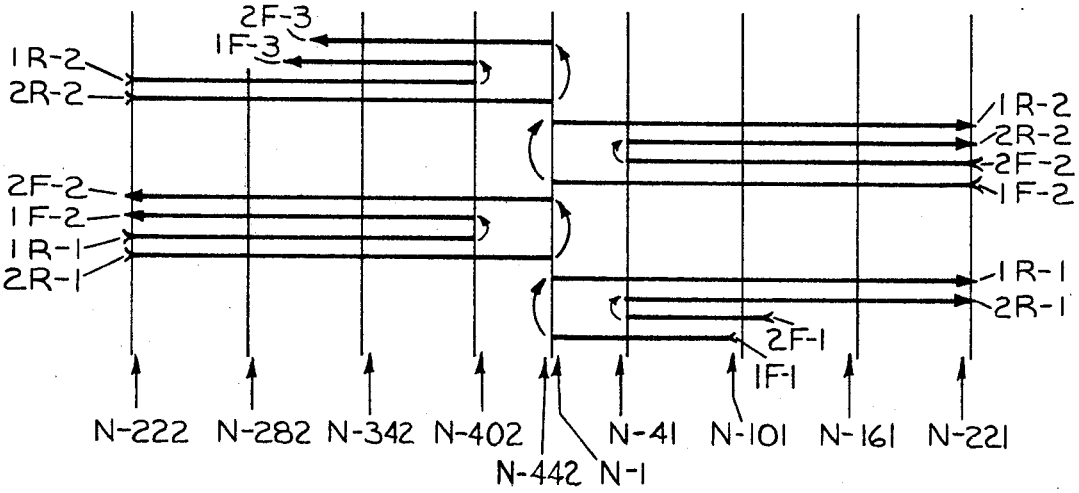

SEAMLESS GARMENT INCLUDING METHOD OF AND MACHINE FOR KNITTING THE SAME

This is a division of application Ser. No. 488,585, filed July 15, 1974.

BACKGROUND OF THE INVENTION

1. Field of the Invention

This invention relates to a one-piece, seamless knitted garment and, more specifically, to such a garment which has a portion which is formed to conform to the body of the wearer by a method of making the same during reciprocal knitting.

2. Description of the Prior Art

Although a large number of one-piece panty hose presently produced are of a type which is formed by sewing two separately knitted halves together, it has long been recognized as desirable to be capable of providing a panty hose which is knitted in one-piece and seamless. A seam detracts from the appearance of the garment and requires an additional manufacturing step which tends to increase its cost.

In an effort to eliminate the seam, some panty hose, such as those of U.S. Pat. Nos. 3,673,821; 3,748,870; 3,802,229; and Re 27,886 have been provided. Although the prior art panty hose of U.S. Pat. Nos. 3,673,821 and Re 27,886 have eliminated the seam which is a characteristic of the sewn hose, they have not been found to possess the overall shape and size characteristics heretofore provided by the sewn garments which are also desired by the wearer. By using partial courses or heel pouches some contour is provided to the body of these prior art panty hose. However, the resulting terminated yarn ends or weakened gore lines tend to detract from the overall appearance of the garment and to thereby reintroduce one of the undesired features of the sewn garment which the seamless, one-piece hose was expected to eliminate. The same observation can be made for the panty hose of U.S. Pat. Nos. 3,748,870 and 3,802,229 in which gussets are formed by a widening and narrowing process which leaves obvious gore lines even though the shape is improved.

Another area of concern has been with the waist opening and the waistband of the panty hose garments. If the waistband is sewn to the garment, the band generally has acceptable expansion qualities and a proper location for eventual positioning at the waist of the wearer. However, sewn waistbands have added to the total cost of the garment due to the additional sewing step that is required during production. Introducing expansion yarn to a specified area of the garment during continuous rotary knitting requires the expansion yarn and the panty yarn to be cut so that a plurality of terminated yarn ends are located within the body of the finished garment and at the waist opening. These terminated yarn ends detract from the appearance of the garment although some at the waist opening may be hidden at an added expense by rolling and sewing. Although waistbands have been disclosed in the U.S. Pat. No. 3,748,870 which may be formed by reciprocal knitting to eliminate terminated yarn ends, in both types of integrally knitted waistbands heretofore utilized, the opening has been in the form of a narrow elongated slot with a wale-wise orientation.

This configuration for the waist opening has two obvious drawbacks. First, the larger the waist opening during rotary knitting, the greater will be the extension of the elongated slot into the area of the side panels. Since the wearer requiring a large waist opening will probably have large hips, this extension into the side panels decrease the rise of the garment along the hips to prevent the opening from being properly located at the waist of the wearer. If more knitting courses are added at the hips, there is likely to be a required increase in the number of courses at the crotch area which could effect the overall shape of the garment by giving it a tendency to be baggy at the crotch and the front and rear panels of the body portion.

Secondly, since the expansion of the knitted band, because of its orientation in the prior art panty hose discussed hereinabove, will be limited to the wale-wise direction tending to elongate the knitted loop, its elastic characteristics are limited. Expansion in the course-wise direction of knitting which tends to widen the loop is generally preferred for waistbands because it is capable of more expansion at a greater force.

Generally, it should be noted that, to be attractive economically, any panty hose garment should be made as quickly as possible. It is further recognized that each additional manipulation or step which is required to produce the garment will have a tendency to increase its cost and that the most desirable method of production would accordingly be by continuous knitting of the entire garment including the waistband.

SUMMARY OF THE INVENTION

It is therefore an object of the invention to provide a one-piece, seamless knitted garment having a body portion with a shape that substantially conforms with the shape of the wearer.

It is a further object to provide a garment of the type described which has a waist opening defined by an integrally knitted waistband.

It is another object to provide a garment of the type described in which the shape and location of the waist opening do not alter the overall conformation of the garment to the shape of the wearer and the waistband includes improved expansion characteristics.

It is still another object to provide a garment of the type described which can be quickly and simply produced and which is attractive in appearance.

It is yet another object of the invention to provide a method of making a garment of the type described.

It is still a further object of the invention to provide a knitting machine on which a garment of the type described can be produced.

To accomplish these and other objects of the invention, a preferred embodiment thereof includes a one-piece, seamless garment knitted on a circular knitting machine having four circumferentially spaced knitting feeds. The garment includes a body portion formed substantially during reciprocation of the machine to include a pair of leg receiving openings, a pair of side panels and a front panel and a rear panel joined at a crotch located between the leg openings. Each of the front and rear panels includes adjacent to the crotch a plurality of knitted courses which originate respectively from a first and a second of the knitting feeds and which terminate at course reversals which overlap the course reversals of the plurality of knitting courses of the other of the front and the rear panels at the crotch to provide the joining of the front and the rear panels. Each of the front and rear panels has a region remote from the crotch which includes more knitting courses than the plurality of knitting courses adjacent to the crotch. Some of the knitting courses at the remote region of the front panel and the rear panel originate from the first knitting feed and the second knitting feed, respectively, and terminate at course reversals without extending to the crotch.

The pair of side panels of the body portion is formed substantially of recriprocated knitting originating from a third and a fourth of the knitting feeds to include knitting courses which terminate at course reversals at least some of which overlap corresponding course reversals of the first and the second knitting feeds at the front and rear panels, respectively.

The body portion includes a waist opening which is remote from the pair of leg receiving openings and the crotch and is defined by a stretchable waistband. The waistband includes expansion yarn which is knitted within the body portion in continuous reciprocated courses terminating at course reversals which define the wale-wise periphery of the waistband. The waistband has a front section, a pair of side sections and a rear section as the third knitting feed supplies expansion yarn to the front section and the fourth knitting feed supplies expansion yarn to the rear section. The waist opening is provided by the absence of feeding at and knitting with a substantial number of needles and each of the side sections of the waistband has a substantial length in a course-wise direction. The garment also includes a pair of leg portions formed substantially during rotation of the knitting machine and integrally joined to the body portion at the pair of leg receiving openings. The invention further includes the method of making the garment and an improved machine for making the same.

BRIEF DESCRIPTION OF THE DRAWINGS

FIG. 7 is a perspective view of another alternative garment with some important features of the invention drawn in simplified, expanded form.

FIG. 8 is a diagram of the knitting and feeding controls of the machine for making the garment shown in FIG. 7.

DETAILED DESCRIPTION OF THE PREFERRED EMBODIMENTS

Figure 1:
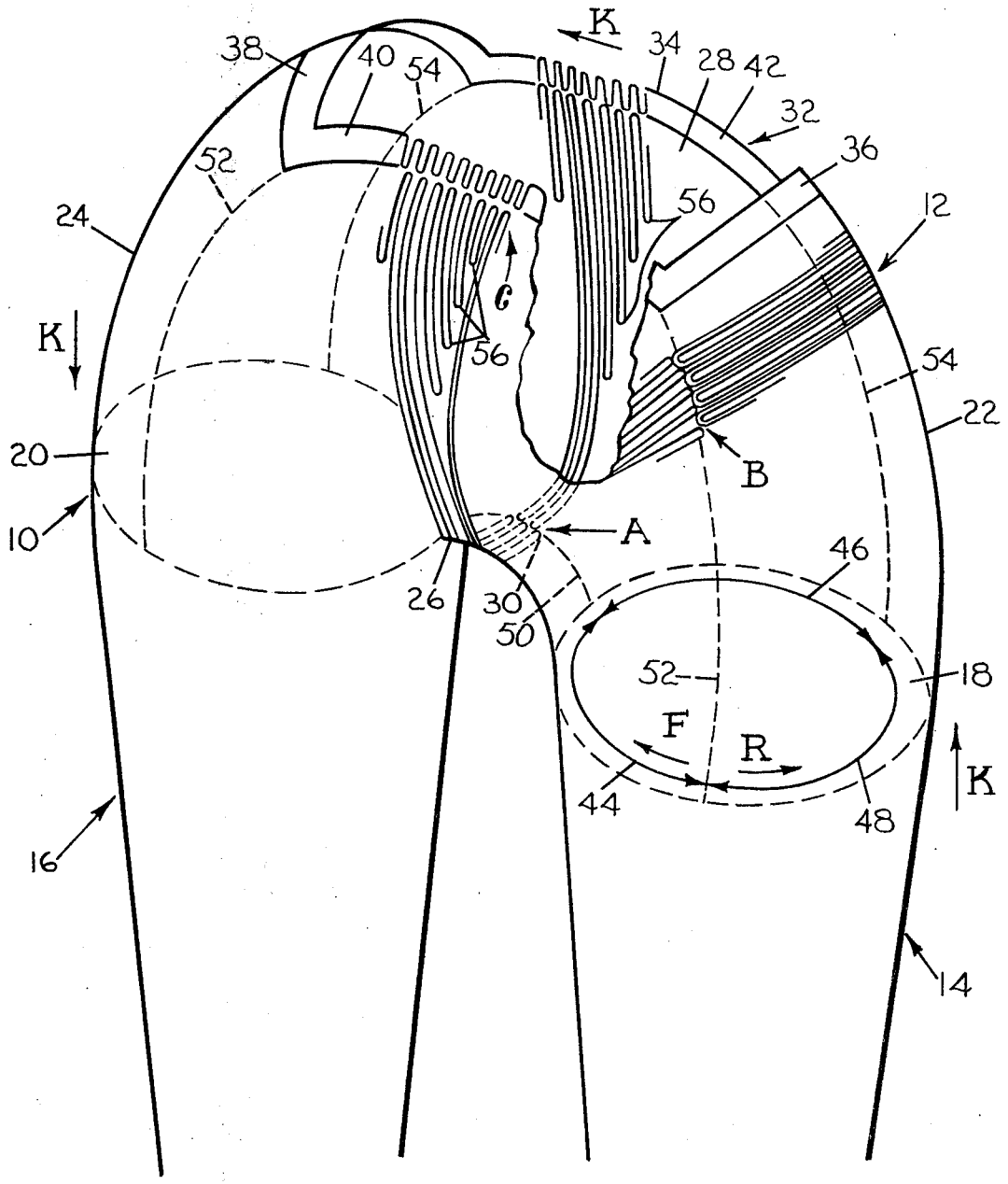
FIG. 1 is a perspective view of the preferred garment with some important features of the invention drawn in simplified, expanded form.

As seen in FIG. 1, a preferred one-piece, seamless knitted garment 10 of the present invention is in the form of a pair of panty hose or the like and includes a body portion 12 and a pair of leg portions 14 and 16. The leg portions 14, 16 are integrally joined to the body portion 12 at a pair of leg receiving openings 18 and 20, respectively, of the body portion 12. The body portion 12 further includes a pair of side panels 22 and 24 and a front panel 26 and a rear panel 28 which are joined at a crotch 30 between the leg receiving openings 18, 20. A waist opening 32 in the body portion 12 is defined by a waistband 34 having side sections 36 and 38 and a front section 40 and a rear section 42.

The preferred garment 10 is made on the basic circular knitting machine of U.S. Pat. No. 3,136,145, which has been improved by the present invention to include appropriate needle and feed controls. Basically, the knitting machine of U.S. Pat. No. 3,136,145 is capable of rotary and reciprocal knitting of yarn from each of four feed stations. The basic needle control mechanisms are capable of a wide range of needle selections whether knitting in a forward or reverse direction. One feature of significance is that the needles are maintained at a lowered position when not selected for knitting. This prevents inactive needles from extending into the path of the feed yarn where they might interfere with the feeding operation of other needles.

The specific improvement in the basic circular knitting machine cited above which is of primary interest and which would enable one to produce an embodiment of the invention includes the particular settings which must be made to the knitting control systems. The detailed description of the preferred garment hereinbelow including such things as the number of courses and the number of needles in each section thereof can be utilized by one skilled in the art of knitting machines to establish these settings. Of primary concern will be the cylinder drive system which includes associated clutch control cams, the arrangement of which causes the cylinder to rotate or reciprocate according to the desired patterns. Additionally, the selector drums will include an array of bars thereon which have a predetermined arrangement of radially extending lugs which facilitate selection of the needles according to the knitting pattern. The detailed description hereinbelow including the diagram in FIG. 2 will enable one to make the required settings as necessary to produce the preferred garment.

Although it will be apparent to those skilled in the art of knitting, it should be pointed out that other circular knitting machines, including but not limited to revised or improved versions of the machine of U.S. Pat. No. 3,136,145, could be employed to practice the invention. However, to provide a supporting foundation for the disclosure of the invention presented hereinbelow, frequent references will be made to the above-cited patent and to various features of the machine disclosed therein. Although some components emphasized in U.S. Pat. No. 3,136,145 are utilized in the formation of the garment presented therein, it will be understood that they may not be required for the present invention. As an example, although this prior art machine includes five levels of pattern control drums and utilized them all to make the garment disclosed therein, only two levels would be required for the preferred garment 10 because of its simpler pattern requirements.

Additionally, some features of the basic machine are appropriate for knitting course gauge hosiery and could accordingly be utilized to effectively produce some embodiments of the present invention. However, since the preferred embodiment, in the form of garment 10, is a fine gauge product, some components should be replaced by systems which are well known in the art as appropriate for fine gauge knitting and are, therefore, not considered as improvements within the scope of the present invention. Specifically, rather than utilizing a one speed motor and gear box driving arrangement, the machine would be equipped with a variable or multi-speed motor for reduced knitting time. Further, a continuous air flow system for holding the terminated yarn ends from the knitting field would be employed rather than a cutting and clamping system because of the closer needle spacing.

In the preferred circular knitting machine for forming the garment 10, the needle cylinder includes four hundred forty-two needles and rotates counter-clockwise for knitting in a forward direction so that the knitting progresses in a clockwise direction F about the surface of the garment 10. Reversing the needle cylinder causes knitting to progress in a counter-clockwise direction R on the garment 10.

Figure 2:
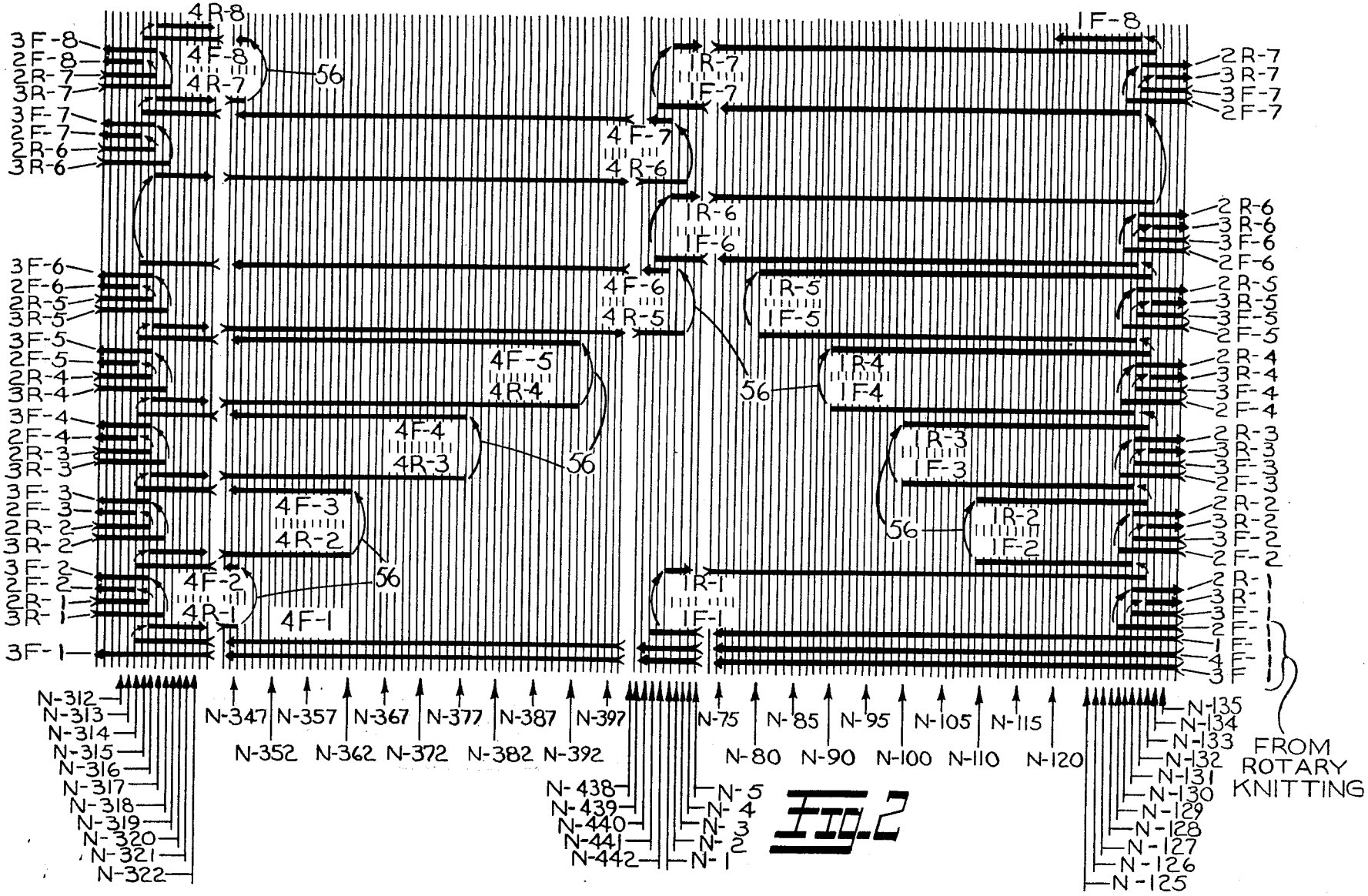
FIG. 2 is a diagram of the knitting and feeding controls of the machine for making the garment shown in FIG. 1.

The needles of the cylinder are numbered for the preferred machine, as shown in FIG. 2 and as discussed in detail hereinbelow, from N-1 to N-442 in a counter-clockwise direction about the cylinder so that yarn fed to N-442 will next be fed to N-441, etc., when knitting in the forward direction F. The Feed Nos. 1, 2, 3 and 4 are circumferentially spaced about the machine in a counter-clockwise direction by number. Therefore, if rotary knitting in the forward direction F, the knitting of yarn from Feed No. 1 by any particular needle will be followed by the knitting of yarn from Feed No. 2, etc.

During rotary knitting all four hundred forty-two needles might be activated to knit yarn from any or all of the four feed stations. Utilizing all four feed stations during rotary knitting is preferred in order to minimize knitting time. For reciprocal knitting, it is not uncommon to limit the area of feeding from any one feed station to the needles within a one-fourth circumference of the needle cylinder adjacent the location of the feed station. For less complicated garments, limiting and equalizing the knitting sectors in this manner allows the machine to be operated through a minimum degree of swing as it reciprocates and thereby tends to reduce the required knitting time. This factor is of real concern since reciprocal knitting is significantly slower than rotary knitting because of the mechanical limitations of stopping and reversing the cylinder during reciprocation. However, if as in the case of the present invention, it is desirable to alter the size of the knitting sector, the basic machine of U.S. Pat. No. 3,136,145, can accordingly be regulated to allow feeding by each feed station at any desired number of needles and to provide an appropriate degree of cylinder swing to facilitate the knitting at each preselected needle. It should be noted that the minimum degree of cylinder swing for feeding to one-fourth of the needles, for example, must be significantly greater than 90° because of the necessity of having some amount of initial movement of the cylinder for selection and activation of the needles prior to actually feeding yarn thereto in each direction of knitting.

Returning to the formation of the garment 10 of FIG. 1, the first leg portion 14 is rotary knitted with yarn simultaneously supplied from all four feed stations, in a direction as indicated by the letter K, from the toe toward the body portion 12 in any one of several styles and methods known in the art. Formation of the leg portion 14 continues until knitting progresses to the area of the leg receiving opening 18 where the preferred knitting machine is adapted to shift to reciprocal knitting to begin the formation of the body portion 12. The actual number of rotary knitted courses for the leg portion 14 is predetermined by such factors as foot style and size. Because the present invention is primarily directed to the body portion 12, it can be seen that the leg portion 14 might be considerably altered with the resulting garment still being within the scope of the invention. For example, if a pair of panties rather than a pair of panty hose is desired, the leg portion may simply be a few courses of rotary knitting with expansion yarn included to simply provide an expandable leg band at the leg receiving opening 18. Further, any number of the feed stations, rather than all four, might be utilized despite the resulting loss of knitting time. As another alternative, some reciprocal knitting may be desired for some heel or toe designs for the leg portion.

During reciprocal knitting of the body portion 12, knitting of the yarn from Feed No. 1 is generally limited to the sector of garment indicated at 44 to form the front panel 26. Feed No. 4 supplies yarn to sector 46 for the formation of the rear panel 28. Feed Nos. 2 and 3 both feed yarn along the sector 48 to cover the area of the side panels 22, 24 of the body portion 12 with double courses of knitting with each swing of the needle cylinder.

For a better understanding of the invention, selected sections of the body portion 12 are shown in FIG. 1 to include a simplified representation of the knitted courses to demonstrate the method of knitting employed. A detailed disclosure of the knitting pattern and its appearance at several locations within the body portion 12 is provided by FIG. 2 and by FIGS. 3, 4 and 5 respectively. Therefore, the lines shown in FIG. 1 represent the courses of knitting only with the interconnecting loops omitted for the purposes of clarity. It can be seen that the knitting course lines shown in the front panel 26 are continuous and extend within an area defined by the sector 44 by the courses being reversed at its edges. The same is true for the courses of yarn supplied by Feed No. 4 for the rear panel 28 within section 46. The double courses of the side panels 22, 24 are also limited to their sector 48 by course reversals of both Feed Nos. 2 and 3.

For an accurate and more detailed understanding of the knitting method involved, a schematic diagram of the knitting control pattern of knitting is provided in FIG. 2. FIG. 2 shows the actual knitting selections that are utilized in the formation of the garment 10 as the knitting machine is being shifted from rotary to reciprocal knitting at the leg receiving opening 18. From the control pattern, one can determine the activity of each needle in the machine at any given time during the formation of the body portion 12, including the source and direction of the yarn being knitted and the identity of the adajcent courses to which it will be joined.

As indicated along the base of FIG. 2, the space between each vertical line of the diagram represents a needle N. Although four hundred forty-two needles of the knitting machine are not shown, a sufficient quantity of needles N by specific number are provided to enable one with a general understanding of the method employed to project the pattern to include the omitted needles. The heavy horizontal lines intersecting the vertical needle spaces are provided to indicate when each particular needle is to be activated in order for yarn to be fed to and knitted by that particular needle. These knitting lines are identified according to the particular feed stations involved, the direction of knitting, and the sequence in which the knitting occurs. For example, beginning at the lower right hand corner of FIG. 2, is the conversion from rotary to reciprocal knitting as all four feed stations supply yarn for knitting in the forward direction F of a first course. The designator 3F-1 indicates that Feed No. 3 is to supply yarn for knitting of the first course in a forward direction F by each needle N. As simultaneous knitting of yarn from all four feed stations continues in the forward direction, the knitting of yarn from Feed No. 4, at 4F-1, continues until reaching needle N-314. Knitting course 1F-1 continues until needle N-441 while 2F-1 continues until being knitted at needle N-129.

Because the control pattern is a two-dimensional representation for a circular machine and garment, knitting line 3F-1, which continues beyond the left of FIG. 2 at needle N-312, re-enters from the right of FIG. 2 at needle N-135. In the same manner, all other knitting courses which extend beyond either edge of FIG. 2 will re-enter from the opposite edge as knitting continues in the same direction around the garment with all of the needles between N-135 and N-312 being activated. To allow a further conservation of space in FIG. 2, the same continuation of knitting courses from "arrow head" to "arrow tail" allows one to also determine the needle activity of all needles N which have been omitted.

Since the sequence of knitting in the pattern presented in FIG. 2 is from the lower portion of the Figure to the upper portion, analyzing the activity of any needle N will enable one to determine how the courses are formed and interconnected. For example, needle N-1 will initially knit yarn from Feed Nos. 3, 4 and 1 in the forward direction F as the leg portion 14 is completed at 3F-1, 4F-1, and then 1F-1. As reciprocation is begun and the knitting is reversed to direction R, another loop of yarn from Feed No. 1 will be formed by needle N-1 as course 1R-1 is interconnected with the loops from course 1F-1. Needle N-1 is then held inactive as the cylinder is swung several times as knitting continues at other needles until course 4R-5 is knitted at needle N-1. The yarn from Feed No. 4 is not knitted at needle N-1 when the machine reverses direction at course 4F-6 since the knitting of course 4F-6 is not initiated until needle N-442. At the course reversals, indicated by the small generally vertical arrows in FIG. 2, the yarn extends unbroken from the last formed loop of a course in one direction to the first loop formed by knitting in the opposite direction. The next knitting at needle N-1 is at course 1F-6 which is thereby interlocked with course 4R-5. Further analysis of N-1 or any other needle N enables one skilled in the art to determine the method of interconnecting all of the courses as the body portion 12 is formed.

From FIG. 2, it can also be seen how the knitting of yarn from Feed No. 1 is limited to needles N-441 through N-132 during reciprocal knitting of the preferred machine to form sector 44 of the body portion 12. Yarn from Feed Nos. 2 and 3 extends from needle N-129 through N-317 to define sector 48. Knitting courses supplied by Feed No. 4 form sector 46 and extend from needle N-314 through needle N-2. The course reversals at the edges of the sectors 44, 46 and 48 overlap course reversals of knitted courses of yarn from the other feed stations at the edges of their respective knitting sectors to provide overall integrity to the knitted garment 10. Although there is a perceptible difference in the knitted pattern at the overlap areas, represented in FIG. 1 by the dotted lines 50, 52 and 54, the variation of texture is not as dominate as that resulting from gore lines or sewn stitches and, therefore, does not tend to detract from the overall appearance of the garment 10.

Figure 3:
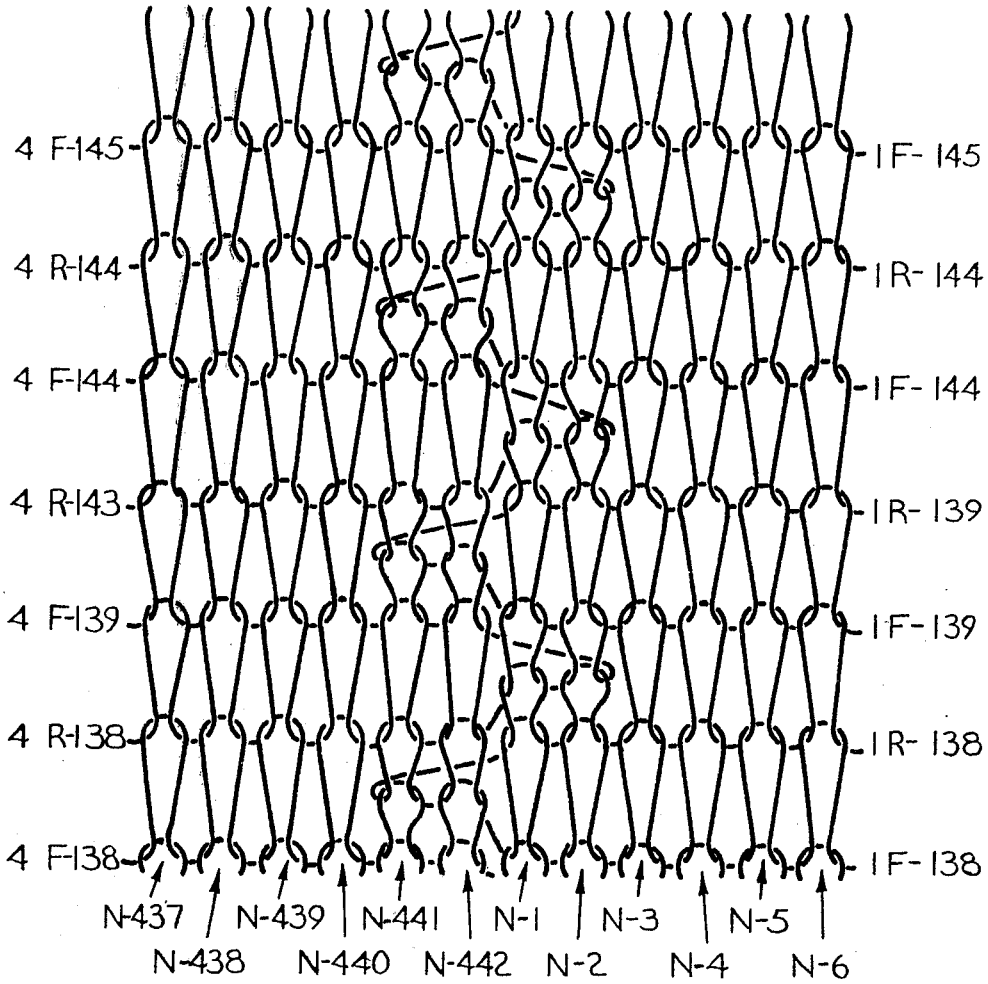
FIG. 3 is an enlarged schematic view of the knitting of the garment shown in FIG. 1 in the area indicated by 3.
Figure 4:
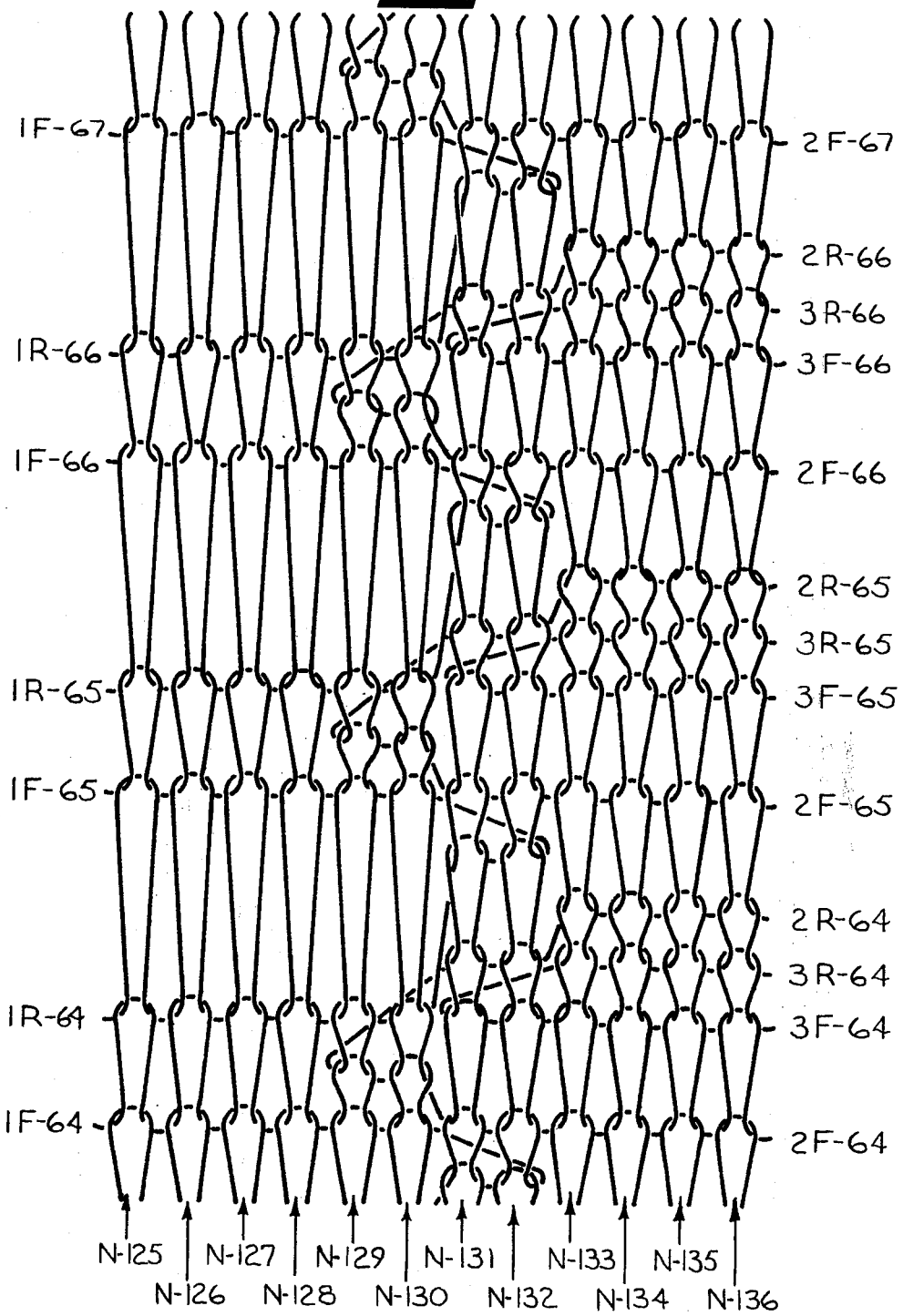
FIG. 4 is an enlarged schematic view of the knitting of the garment shown in FIG. 1 in the area indicated by 4.
Figure 5:
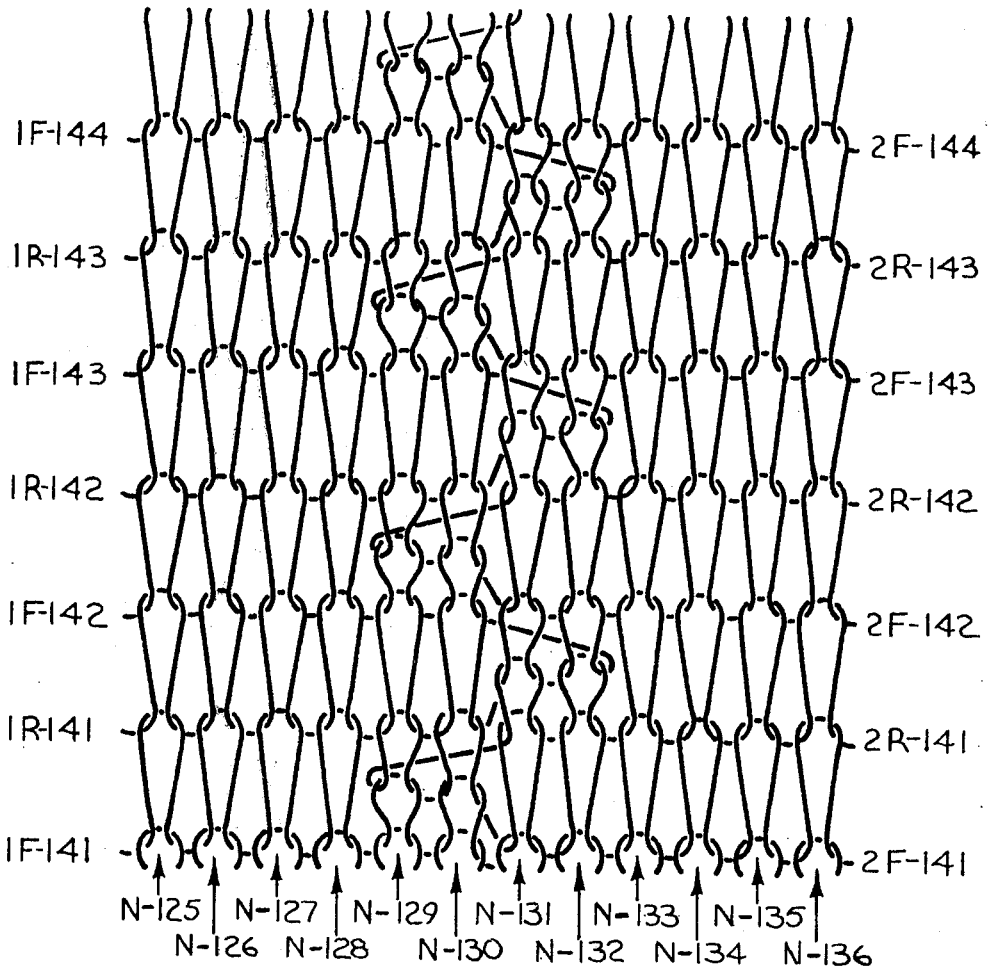
FIG. 5 is an enlongated schematic view of the knitting of the garment shown in FIG. 1 in the area indicated by 5.

The appearance of the overlap area 50 at 3 and of the overlap area 52 at 4 and 5 in FIG. 1 can be seen in FIGS. 3, 4 and 5, respectively. The schematic knitting shown in these Figures include appropriate designations for the needles N utilized to form the loops and for the source of supply yarn. The course designations accurately reflect the location of the knit on the garment 10 and thereby provide a conformation of the detailed description to be provided hereinbelow of how the needle control pattern of FIG. 2 is extended to produce the body portion 12.

However, having provided an initial explanation of the general relationship of the feeding of yarn from the feed stations and the activation of needles for reciprocal knitting, it is appropriate to discuss the specific features of the knitting control pattern of FIG. 2 which provide the desired shape to the body portion 12. It is a broad aim of the present invention to provide a method of reciprocal knitting which results in more material being knitted along one circumferential section of the garment than another.

Initially, it can be seen that, by restricting the number of knitting courses that extend across the full width of sectors 44 and 46, there are less knitted courses adjacent the crotch 30 than there are at a region of the front panel 26 and rear panel 28 which is remote from the crotch 30. For every course adjacent the crotch 30 there are two at the remote region.

Further, by providing different lengths for the shortened courses which are supplied by Feed Nos. 1 and 4 by locating the course reversals 56 at different distances from the crotch 30, the transition from a lesser to a greater number of courses is gradual. The resulting front panel 26 and rear panel 28 have a contour which is narrower at the crotch 30 to conform with the shape of the wearer.

Additionally, to provide greater rise at the side panels for more material at the hips of the wearer, twice as many courses are provided at sector 48 than at sectors 44 and 46. As a result, for each course adjacent the crotch 30, there are six courses at the side panels to provide ample material at the upper portion of the body of the wearer while preventing an excess of material at the crotch.

The preferred method of knitting the garment 10, as demonstrated by the control pattern of FIG. 2, is further capable of providing an even more refined means of conforming to the body of the wearer than the basic narrowing means described hereinabove. An examination of the lengths of the shortened courses of the rear panel as compared with the lengths of the shortened courses of the forward panel in FIG. 1 will reveal that the rear panel is provided more material in recognition of the fact that the seat of the wearer is larger than the front. The specific number of needles per course can be determined from FIG. 2 for the preferred garment 10, but it can also be seen that, considering the capabilities of the basic machine of U.S. Pat. No. 3,136,145, one skilled in the art who utilizes the methods disclosed herein can make a garment which quite accurately conforms to the body of the wearer.

Returning to the preferred method of making the garment 10, as the formation of the body portion 12 continues from the leg receiving opening 18, the pattern, as established in FIG. 2, is repeated until the side panel 22 is completed up to the side section 36 of the waistband 34. As reciprocal knitting continues with the Feed Nos. 1 and 4 unaltered, expansion yarn is substituted for panty yarn at Feed Nos. 2 and 3 to form the side section 36.

To complete the side section 36 of the waistband the yarn being fed to a substantial number of needles in sector 48 is removed causing the needles to press-off the loops and attendant fabric after construction of some type of run barrier known in the art. The needles are then held inactive to prevent any feeding to or knitting at the waist opening 32. Simultaneously, Feed No. 2 and Feed No. 3 are caused to knit simple, shortened courses at the front section 40 and the rear section 42 of the waistband 34 respectively. The loop pattern within the overlap areas 52 and 54 at the center of the waistband 34 is shown in FIG. 5 and, by a comparison with FIG. 3, can be seen to be similar to the loop pattern at the crotch 30.

When the front section 40 and the rear section 42 are completed, all of the needles of sector 48 are reactivated in a 1 by 1 make-up arrangement in a manner known in the art so that Feed Nos. 2 and 3 might again supply double courses of expansion yarn to form the side section 38 of the waistband 34. Replacing the expansion yarn of Feed Nos. 2 and 3 with panty yarn allows the side panel 24 to be formed until the body portion is completed at leg receiving opening 20. Returning to rotary knitting at the opening 20, the leg portion 16 is provided to complete the formation of garment 10.

To provide some feel for the knitting time required for the body portion 12 and to supply a more accurate perspective to the knitting pattern than can be shown by FIG. 1, some parameters of a typical garment made by the preferred method and on the preferred machine should be presented. In the garment 10, each side panel 22, 24 has approximately 288 courses which are formed as 144 courses are knitted in the front panel 26 and the rear panel 28 along the overlap areas 52 and 54, respectively, with only 48 of them extending to the crotch 30. Each side section 36, 38 of the waistband 34 includes 84 knitted courses and the front section 40 and rear section 42 have 192 courses each. There are only a total of 188 courses adjacent the crotch 30 as the body portion 12 is knitted from leg receiving opening 18 to leg receiving opening 20.

The side panels 22, 24 utilize about 182 needles so that sector 48 covers about 148 degrees of the circumference of the knitted garment 10. The front and rear panels are each knitted with about 130 needles covering 106° of the circumference of the garment. Since 100 needles are idle during the formation of the waist opening 32, each of the front section 40 and rear section 42 of the waistband 34 require about 41 needles. However, variations in the number of courses, the number of needles or the size of the sectors may be made as desired to alter the shape of the garment without departing from the scope of the invention.

Since the side panels cover the largest sector of the garment, they determine the swing of the cylinder that is required during reciprocal knitting. Further, since Feed Nos. 2 and 3 are circumferentially displaced from each other, a greater degree of swing is required than if only one feed station were utilized. Therefore, a cylinder swing of 340° is needed during reciprocal knitting to form the body portion 12 and to provide sufficient initial movement of the cylinder on each swing to activate the needles. Since the knitting areas are altered during the formation of the waist opening, the full swing of 340° would not be essential in this region of the body portion 12.

Although a cylinder swing as large as 340° would appear to lengthen knitting time, it is of significance in determining the total knitting time required that the side panels are knitted with double courses from Feed Nos. 2 and 3 on each swing. Since the amount of material required for the side panels greatly influences the total knitting requirement, the overall knitting time is not unduly altered by the larger degree of swing, because of the double knitting. Although each swing of the cylinder to make the preferred garment takes longer, less of them are required to provide sufficient rise at the side panels.

Utilizing the capabilities of the basic machine of U.S. Pat. No. 3,136,145, and the method of knitting disclosed hereinabove, it can be seen that the preferred garment might be changed by an alteration of the needle control pattern by one skilled in the art if desired. For example, although the rectangular opening 32 and corresponding waistband 34 have been found to comfortably encircle the waist of a wearer, the corners could, if desired, be rounded. By extending the courses of the front and rear panels into the area of the side panels, the initial courses of the side section of the waistband could be shortened. Gradually shortening the extended courses of the front and rear panels as the side section courses are lengthened would give a tapered edge to the waistband. A corresponding taper could be provided for the waist opening by initially deactivating, without pressing-off a lesser number of needles centrally located in the side panel sector of the garment so that each side feed respectively supplies shortened courses at opposite sides of the central area. Continued shortening of the courses with each reciprocation as more needles are deactivated provides the basic rounded shape to the waist opening when the total number of desired needles have been deactivated. By reactivating all the needles for a run-down barrier and then pressing-off the fabric, the first edge of the opening can be completed. To form the other side of the rounded opening, knitting with all needles is reactivated by make-up sequence for several courses. The centrally located needles are again held inactive until progressively longer courses at opposite sides of the central area are knitted to provide the shape for the other side of the opening. In this manner, the opening at the second side section will be formed by generally reversing the procedure used in the formation of the first side section of the waistband.

Another possible variation of the garment 10 which might be desired but which would still be within the scope of the invention is in the formation of the overlap areas 50, 52, and/or 54. An unlimited number of patterns might be employed at the overlap areas by varying the number of needles; altering the length of turnaround for the yarn prior to reinitiating the knitting of a course; or applying other pattern techniques known in the art. One such variation might include extending both of the front and rear panels to the waist opening so that the total front and rear sections of the waistband are, in fact, overlap areas.

Figure 6:
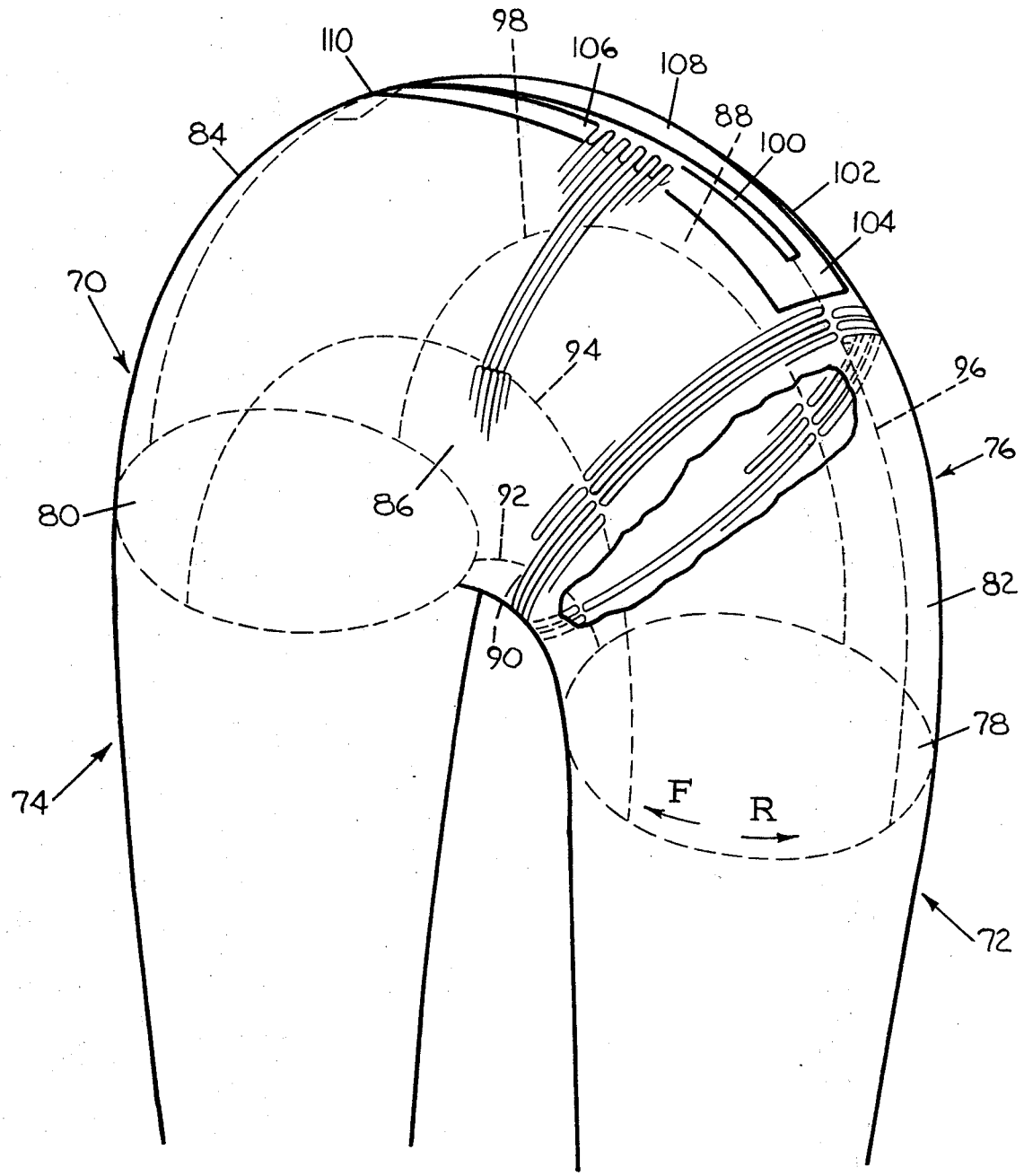
FIG. 6 is a perspective view of an alternative garment with some important features of the invention drawn in simplified, expanded form.

As seen in FIG. 6, an alternative garment 70 can be knitted on the same basic knitting machine of U.S. Pat.

No. 3,136,145. Again, all four feed stations are employed during rotary knitting for the leg portions 72 and 74. The body portion 76 is formed during reciprocation of the machine with each feed station being respectively limited to an approximate one-fourth sector of the garment. This embodiment, therefore, does not require as large a cylinder swing during reciprocation as did the garment 10 of FIG. 1 and can be formed with a swing of about 210°. The body portion 76 again includes a pair of leg receiving openings 78, 80; a pair of side panels 82, 84; and a front panel 86 and a rear panel 88 joined at a crotch 90 located between the openings 78, 80.

The side panels 82, 84 are supplied by Feed Nos. 2 and 3 but the front panel 86 and rear panel 88 of the garment 70 are supplied by both Feed Nos. 1 and 2 and Feed Nos. 4 and 3, respectively because of the smaller knitting sectors utilizing Feed Nos. 1 and 4. The overlap areas 92, 94, 96 and 98 are similar to the area 50 of FIG. 1 and FIG. 3 but might be of an appropriate style as explained hereinabove.

To provide contour for the garment 70, knitting at Feed Nos. 1 and 4 is varied as in garment 10. The particular ratio and length of shortened courses as compared with the courses that extend to the overlap area 92 may differ from that of garment 10 as shown in FIG. 2, but the same method is generally employed. For the purposes of further demonstrating the versatility of the present invention, an alternative waist opening 100 and waistband 102 have been provided for garment 70. By altering the basic knitting machine, it is well known that any preselected needle, while knitting any preselected course, may be raised to a feed position which in higher than normally required for simple knitting. This allows a splicing or plating yarn feeder position to be provided at any feed station in a manner known in the art so that expansion yarn may be presented, along with the regular feed yarn, to the needle at a predetermined stage of the knitting for simultaneous knitting of both yarns.

Therefore, expansion yarn is added at Feed Nos. 2 and 3 to the panty yarn, rather than replacing it, with the use of a splicing or plating yarn feeder position in alignment with needles which are raised to a higher position as described hereinabove. After the side panel 82 of the body portion 76 is completed, knitting in combination with expansion yarn is limited to a predetermined number of needles in each sector adjacent the overlap area 96 to provide a shorter side section 104 for the waistband 102. To provide the opening 100, the needle controls for Feed No. 2 and Feed No. 3 are changed to eliminate any overlapping of the courses supplied thereby. Although all of the needles may remain activated, knitting with yarn from Feed No. 2 in a counter-clockwise direction R will not proceed beyond a particular needle and knitting with yarn from Feed No. 3 in a clockwise direction F will not proceed beyond the needle adjacent the particular needle of Feed No. 2. In other words, since no needle will share expansion or panty yarn from both Feed Nos. 2 and 3 in the area of opening 100, there will be no overlapping of knitted courses. The course reversals of one will not be interconnected with those of the other and will, therefore, provide a finished edge for both the front section 106 and the rear section 108 of the waistband 102. Returning to overlapped feeding of yarn, as at side section 104, closes the opening 100 and results in the formation of the other side section 110 to complete the waistband 102.

When the additional feeding of expansion yarn at Feed Nos. 2 and 3 is discontinued, the body portion 76 and, with a return to rotary knitting, the leg portion 74 may be completed to finish the formation of the garment 70. A figure or drawing of the specific needle control pattern for garment 70 has not been provided since it is felt that an understanding of the more complicated controls of FIG. 2 and the methods disclosed therein would enable one skilled in the art to improve the basic machine of U.S. Pat. No. 3,136,145 to produce the garment 70.

The capabilities of the basic machine allows still another alternative that might be applied to either garment 10 or garment 70. There is presently some concern over the effects of wearing garments of synthetic yarn because of its non-absorbent characteristics. Accordingly, it may be desirable to provide the garments described hereinabove with a means for including cotton, for example within the area of the crotch of the body portion.

To accomplish this objective, it might be appropriate to prevent courses from Feed Nos. 1 and 4 from joining at the crotch by altering the needle control pattern to provide a crotch opening. An absorbent material might then be sewn in at the crotch of the garment which would still have the desired contour and integral waistband features of the invention. Some wearers might not want the material to be added but would prefer this design with the crotch left open. Such a wearer might be planning for some form of pleasure during leisure or just praying for some type of need requiring speed.

By utilizing a splicing or plating yarn feeder position, as with the waistband of garment 70, cotton yarn may be added to the panty yarn at the crotch. This method would provide the desired absorbency without appreciably altering the garment, requiring an additional manufacturing step, or effecting its overall integrity.

Although requiring a more extensive adaptation of the methods taught herein, it would also be possible to provide a garment having a body portion in which one feed station is directed to a sector including the crotch alone. It would require needle controls to knit a relatively few number of courses with cotton yarn which would overlap course reversals of a front and rear panel, each of which would be supplied by a feed station of panty yarn and would include shortened courses to provide the desired contour. The fourth feed station would supply the side panels and the side sections of the waistband and remain idle for the waist opening. The front and rear sections of the waistband could be formed by adding expansion yarn, as in garment 70, at the top of the front and rear panels.

The garments 10 and 70 have been presented in an effort to provide embodiments of the invention and methods by which it may be practiced which are generally preferred. However, an alternative embodiment in the form of garment 120 is shown in FIG. 7 to demonstrate that the invention might be practiced by utilizing a substantially less complicated machine than that of U.S. Pat. No. 3,136,145.

The garment 120 is in the form of a blank for the making of a pair of panties or the like by providing a waist opening and a waistband. Although garment 120 is shown to have a general shape like the embodiments of FIG. Nos. 1 and 6, it is not a preferred embodiment because it will not, in fact, conform as well to the body of a wearer. However, it does serve to demonstrate that an acceptable garment can be provided with only two feeds. Further, the knitting pattern, as shown in FIG. 8, is very simple and remains unchanged throughout reciprocal knitting and will therefore not require the complicated needle selectivity required hereinabove.

The garment 120 has a body portion 122 and a pair of leg bands 124 and 126, rather than complete leg portions as shown for the other embodiments. The leg bands 124, 126 might be formed by rotary knitting and/or by including expansion yarn. For the body portion 122, there is one knitted course at the crotch 128, about the 80 needles wide or about 65° of the circumference of the garment, for every two courses of the garment 120 in the region thereof which is remote from the crotch 128.

The pattern of FIG. 8 has a scale which includes all of the needles N even though all are not shown by number. The cylinder swing required during reciprocation will depend on the circumferential distance between the two feed stations. If they are 45 degrees apart, the swing will be about 460°. If 90° apart, the swing will be 570°. A swing of about 640° would be needed if the feed stations are 180° apart.

It should be apparent that the present invention and the method for making the same is not limited to the machine of U.S. Pat. No. 3,136,145. The disclosure provided hereinabove will enable one to practice the invention by utilizing other basic knitting machines but while nevertheless being within the scope of the invention as claimed.

What is claimed is:

1. A one-piece, seamless garment knitted on a circular knitting machine comprising:

a body portion formed substantially during reciprocation of said machine to include a pair of leg receiving openings, a pair of side panels and a front panel and a rear panel joining at a crotch located between said leg receiving openings;

each of said front and said rear panels including adjacent to said crotch a plurality of knitting courses which terminate at course reversals which overlap said course reversals of said plurality of knitting courses of the other of said front and said rear panels at said crotch to provide said joining of said front and said rear panels; and said each of said front and said rear panels having a region remote from said crotch which includes more knitting courses than said plurality of knitting courses adjacent to said crotch by some of said knitting courses at said remote region terminating at course reversals without extending to said crotch, said course reversals of said some of said knitting courses being dispersed about said front and said rear panels and separated one from another to prevent the formation of gore lines in said front and said rear panels.

2. A garment as set forth in claim 1, further including a pair of leg portions formed substantially during rotation of said knitting machine and integrally joined to said body portion at said pair of leg receiving openings.

3. A one-piece, seamless garment knitted on a circular knitting machine having at least two circumferentially spaced knitting feeds comprising:

a body portion formed substantially during reciprocation of said machine to include a pair of leg receiving openings, a pair of side panels and a front panel and a rear panel joining at a crotch located between said leg openings;

each of said front and said rear panels including adjacent to said crotch a plurality of knitting courses which originate respectively from a first and a second of said knitting feeds and which terminate at course reversals which overlap said course reversals of said plurality of knitting courses of the other of said front and said rear panels at said crotch to provide said joining of said front and said rear panels; and said each of said front and said rear panels having a region remote from said crotch which includes more knitting courses than said plurality of knitting courses adjacent to said crotch by some of said knitting courses at said remote region terminating at course reversals without extending to said crotch, said course reversals of said some of said knitting courses being dispersed about said front and said rear panels and separated one from another to prevent the formation of gore lines in said front and said rear panels.

4. A garment as set forth in claim 3 further including a pair of leg portions formed substantially during rotation of said knitting machine and integrally joined to said body portion at said pair of leg receiving openings.

5. A garment as set forth in claim 3, wherein some of said knitting courses at said remote regions of said front panel and said rear panel originate from one of said knitting feeds other than said first knitting feed and said second knitting feed, respectively, and terminate at said course reversals without extending to said crotch.

6. A garment as set forth in claim 3, wherein said body portion has a waist opening which is remote from said pair of leg receiving openings and said crotch.

7. A garment as set forth in claim 6, wherein said waist opening is defined by a stretchable waistband.

8. A garment as set forth in claim 7, wherein said waistband includes expansion yarn which is knitted within said body portion in continuous reciprocating courses terminating at course reversals which define the wale-wise periphery of said waistband.

9. A garment as set forth in claim 3, wherein some of said knitting courses at said remote region of said front panel and said rear panel originate from said first knitting feed and said second knitting feed, respectively, and terminate at said course reversals without extending to said crotch.

10. A garment as set forth in claim 9, wherein said knitting machine includes at least three of said circumferentially spaced knitting feeds and said pair of side panels of said body portion are formed substantially of reciprocated knitting originating from a third of said knitting feeds to include knitting courses which terminate at course reversals which overlap corresponding said knitting courses of said first and said second knitting feeds at said front and said rear panels, respectively.

11. A garment as set forth in claim 9, wherein said machine includes at least four of said circumferentially spaced knitting feeds and said pair of said side panels of said body portion are formed substantially of reciprocated knitting originating from a third and a fourth of said knitting feeds to include knitting courses which terminate at course reversals at least some of which overlap corresponding said knitting courses of said first and said second knitting feeds at said front and said rear panels, respectively.

12. A garment as set forth in claim 11, further including a pair of leg portions formed substantially during rotation of said knitting machine and integrally joined to said body portion at said pair of leg receiving openings.

13. A garment as set forth in claim 12, wherein said body portion has a waist opening which is remote from said pair of leg receiving openings and said crotch.

14. A garment as set forth in claim 13, wherein said waist opening is defined by a stretchable waistband.

15. A garment as set forth in claim 13, wherein said waistband includes expansion yarn which is knitted within said body portion in continuous reciprocated courses terminating at course reversals which define the wale-wise periphery of said waistband.

16. A garment as set forth in claim 15, wherein said waistband has a front section, a pair of side sections and a rear section; said third knitting feed supplies said expansion yarn to said front section; and said fourth knitting feed supplies said expansion yarn to said rear section.

17. A garment as set forth in claim 16, wherein said waist opening is provided by the absence of feeding at and knitting with any needle by said third feed when said needle is supplied by said fourth feed to provide a gap between said front and said rear sections of said waistband during their formation.

18. A garment as set forth in claim 16, wherein said waist opening is provided by an absence of feeding at and knitting with a substantial number of needles by said third and said fourth feeds and each of said side sections of said waistband has a substantial length in a course-wise direction.

19. A garment as set forth in claim 12, further including said knitting courses of said third and said fourth knitting feeds terminating at said course reversals within said side panels which overlap said course reversals of the other of said third and said fourth knitting feeds within said side panels.

* * * * *